US010046195B2

(12) United States Patent
Scheffer

(10) Patent No.: US 10,046,195 B2
(45) Date of Patent: Aug. 14, 2018

(54) RESTRAINT DEVICE, IN PARTICULAR FOR TRAINING PURPOSES

(71) Applicant: ERGO-FIT GMBH & CO. KG, Pirmasens (DE)

(72) Inventor: Harald Scheffer, Merzig (DE)

(73) Assignee: ERGO-FIT GMBH & CO. KG, Pirmasens (DE)

( * ) Notice: Subject to any disclaimer, the term of this patent is extended or adjusted under 35 U.S.C. 154(b) by 274 days.

(21) Appl. No.: 14/368,031

(22) PCT Filed: Dec. 20, 2012

(86) PCT No.: PCT/DE2012/100392

§ 371 (c)(1),
(2) Date: Jun. 23, 2014

(87) PCT Pub. No.: WO2013/091625

PCT Pub. Date: Jun. 27, 2013

(65) Prior Publication Data

US 2015/0051056 A1 Feb. 19, 2015

(30) Foreign Application Priority Data

Dec. 22, 2011 (DE) ..... 10 2011 122 104
Oct. 22, 2012 (DE) ..... 10 2012 110 051

(51) Int. Cl.

| | |
|---|---|
| ***A63B 21/02*** | (2006.01) |
| ***A63B 21/045*** | (2006.01) |
| ***A63B 69/00*** | (2006.01) |
| ***A63B 21/015*** | (2006.01) |
| ***A63B 21/00*** | (2006.01) |

(Continued)

(52) U.S. Cl.

CPC ..... *A63B 21/045* (2013.01); *A63B 21/015* (2013.01); *A63B 21/153* (2013.01); *A63B 21/157* (2013.01); *A63B 21/169* (2015.10); *A63B 21/1618* (2013.01);

(Continued)

(58) Field of Classification Search

CPC ... A63B 21/015; A63B 21/045; A63B 21/047; A63B 21/153; A63B 21/157; A63B 21/169; A63B 21/1618; A63B 21/055; A63B 21/0552; A63B 21/0557;

(Continued)

(56) References Cited

U.S. PATENT DOCUMENTS 518,967 A 5/1894 Poole
3,212,776 A * 10/1965 Bassler ..... A61H 1/0214 482/1

(Continued)

FOREIGN PATENT DOCUMENTS

DE 10 2011 053 199 3/2013
WO 2010123948 A2 10/2010

*Primary Examiner* — Gregory Winter
(74) *Attorney, Agent, or Firm* — Lucas & Mercanti, LLP; Klaus P. Stoffel

(57) ABSTRACT

A restraint device, in particular for training purposes, having a holder which is or can be anchored in a fixed position and from which a rope that can be attached to a user can be drawn out against a restoring force via a movement path of the user. Apparatuses for generating the restoring force by sliding friction are provided and include a roller that can be rotated by winding the extendable rope around the roller and a brake device inhibiting the rotation of the roller.

10 Claims, 4 Drawing Sheets

(51) Int. Cl.
*A63B 21/16* (2006.01)
*A63B 23/04* (2006.01)
*A63B 22/00* (2006.01)

(52) U.S. Cl.
CPC ..... *A63B 23/047* (2013.01); *A63B 69/0028* (2013.01); *A63B 2022/0079* (2013.01)

(58) Field of Classification Search
CPC ... A63B 21/16; A63B 21/1645; A63B 21/154; A63B 23/047; A63B 69/0028; A63B 2022/0079
See application file for complete search history.

(56) References Cited

U.S. PATENT DOCUMENTS 3,861,215 A 1/1975 Bradley
3,885,789 A * 5/1975 Deluty ..... A63B 21/018 242/147 R
3,995,853 A * 12/1976 Deluty ..... A63B 21/015 482/116
4,328,965 A * 5/1982 Hatfield ..... A63B 21/025 124/23.1
4,557,480 A * 12/1985 Dudley ..... A63B 21/018 482/120
4,765,615 A 8/1988 Case
4,871,165 A 10/1989 Marshall et al.
5,429,572 A * 7/1995 Brown ..... A63B 21/015 482/116
6,053,850 A 4/2000 Martinez et al.
7,087,001 B1 * 8/2006 Ihli ..... A63B 21/015 119/795
2005/0075205 A1 * 4/2005 Chen ..... A63B 21/154 474/116
2006/0035770 A1 * 2/2006 Crowson ..... A63B 21/00 482/129

* cited by examiner

RESTRAINT DEVICE, IN PARTICULAR FOR TRAINING PURPOSES

TITLE OF THE INVENTION

The present application is a 371 of International application PCT/DE2012/100392, filed Dec. 20, 2012, which claims priority of DE 10 2011 122 104.6, filed Dec. 22, 2011, and DE 10 2012 110 051.9, filed Oct. 22, 2012, the priority of these applications is hereby claimed and these applications are incorporated herein by reference.

BACKGROUND OF THE INVENTION

The invention pertains to a restraining device, especially for training purposes, with a holder, which is or can be permanently mounted, and from which a line, which can be connected to a user, can be pulled out against a restoring force over the distance traveled by the user, wherein devices for producing the restraining force by sliding friction according to prior patent application DE 10 2011 053 199.8 are provided, the contents of DE 10 2011 053 199.8 being herein incorporated by reference As described in the prior application, training for fast starts in sprint-type races, for example, can be intensified by calling upon the runner not only to produce high acceleration forces but also to overcome a restraining force. To produce a restraining force, the conventional solution is to use elastically stretchable straps connected at one end to the runner and at the other end to a support; the runner then runs a short sprinting distance while stretching the straps out lengthwise.

SUMMARY OF THE INVENTION

A restraining device of the type mentioned above which can be used for training purposes as described in the prior application is elaborated by the present invention in that the device for producing the restraining force by sliding friction comprises a pulley, which turns as the extendable line is being pulled from it, and a braking device, which inhibits the turning of the pulley.

The pulley just mentioned, which can serve simultaneously as a deflecting and guide pulley, can be adjusted by the braking device so that it turns only with difficulty and thus produces the restraining force. The pulley inhibited by the braking device can be a supply pulley, from which the line is unwound, and/or a separate pulley downstream from such a supply pulley. In the latter case, the restraining force is independent of the distance by which the line is pulled out.

In a further elaboration of the invention, the extendable line, preferably designed as a rope, can be unwound from the supply pulley as the supply pulley rotates against a restoring torque, especially the torque of a spring. The restoring torque, which is small in comparison to the restraining force produced by the braking device, can be used advantageously as a means of automatically rewinding of the line into the holder.

The separate pulley is preferably able to rotate freely, unhindered by the braking device, in the direction opposite the rotational direction in which the line is pulled out. It is advantageous in this case that the braking device does not need to be released to allow the automatic rewinding function to operate.

In one embodiment, the braking device comprises a brake disk, which can be acted upon in the direction of the rotational axis of the pulley by a preferably adjustable braking force. The amount of braking force is advisably set by the use of a compression spring of adjustable pretension acting on the brake disk.

In a further embodiment of the invention, the holder comprises a U-shaped element connected to the ends of the holder, as a result of which a device is obtained which can be anchored to various types of supports.

The U-shaped element is preferably hinged rotatably to the holder so that it can turn around a rotational axis extending between the ends of the U.

The invention is explained further in the following on the basis of an exemplary embodiment and the attached drawings, which illustrate this exemplary embodiment:

DETAILED DESCRIPTION OF THE INVENTION

Figure 1:
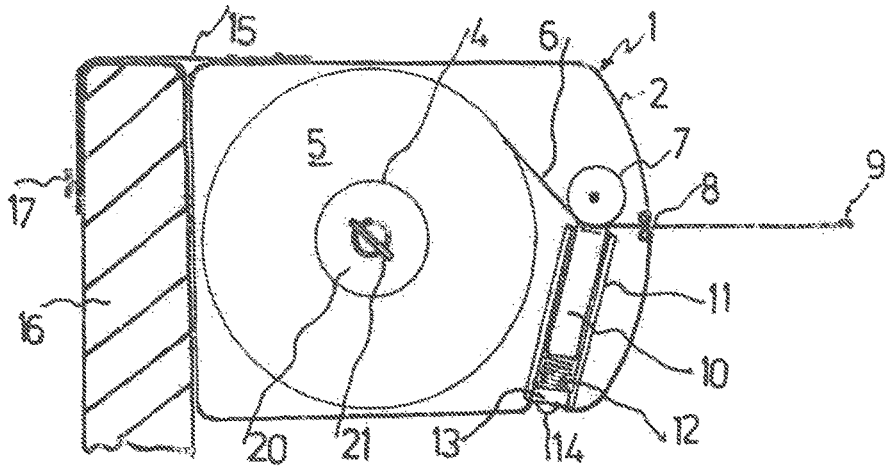
FIG. 1 shows a cross-sectional side view of a holder of a device described in the parent application.
Figure 2:
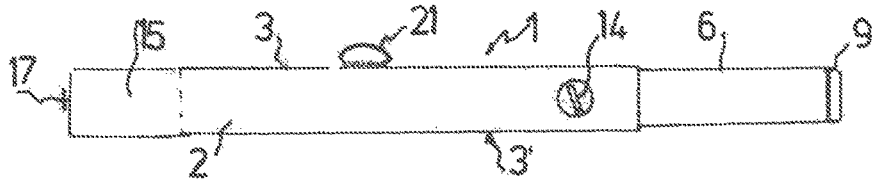
FIG. 2 shows a side view of the holder of FIG. 1 from below.

A restraining device comprises a holder 1, which consists of a flat housing 2 with opposing side walls 3 and 3', between which a pulley 4 is supported with freedom to turn around an axis perpendicular to the side walls. A strap-like line 6 is wound around the pulley 4 to form a winding 5.

The strap-like line 6 rests against a pulley 7, which deflects it toward a slit-like opening 8 in the housing. At the free end outside the housing, the line 6 has a connecting means, which, in the present exemplary embodiment, is an eyelet 9.

One end surface of a friction element 10 rests against the line 6 and pushes the line 6 against the pulley 7. A sleeve 11 serves to guide the friction element 10 and also serves as a receptacle for a helical spring 12, one end of which rests against the other end surface of the friction element 10. The other end of the helical spring 12 presses against a screw element 13, which can be turned into the sleeve 11, the screw element carrying a projecting gripping part 14.

In the exemplary embodiment shown here, a hook-like anchoring element 15 is attached to the housing 2 of the holder 1; this anchoring element is used to attach the device to a wall 16, which forms the opposing support, and can be fixed in place by a screw 17. In addition to the positioning of the anchoring element 15 by means of the screw 17, it would also be possible to adjust the element in the direction of the length of the hook arm, so that it can be adapted to walls of different thickness. The holder 1 could also comprise additional anchoring elements in the form of flexible straps, for example, so that the device can be attached to opposing supports of different designs. Means for attaching the device to a post, designed to be driven into the ground to serve as a support, for example, would also be possible.

Figure 3:
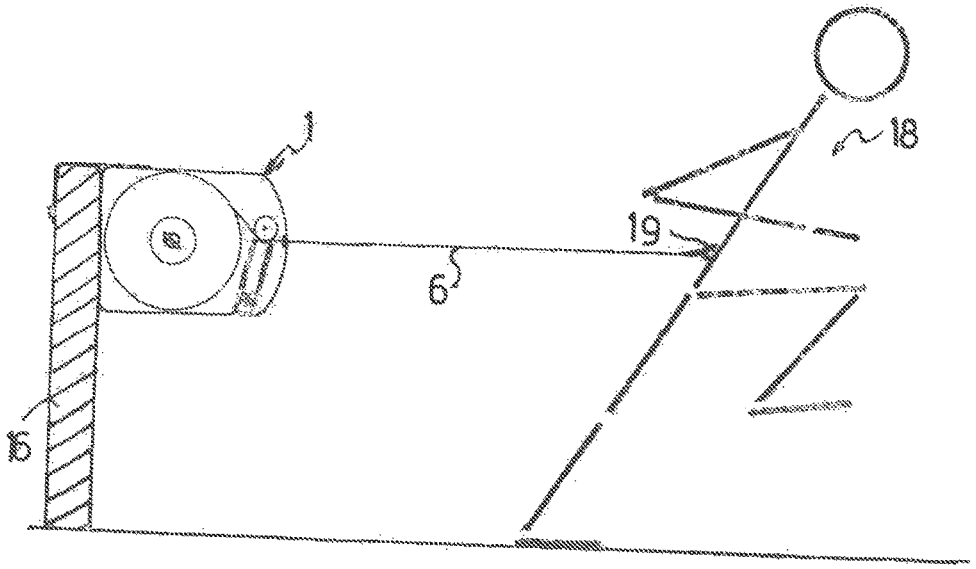
FIG. 3 shows a diagram explaining the function of the device of FIG. 1.

The restraining device described above can be used in particular for training purposes, as will be explained on the basis of FIG. 3. A sprinter 18 is practicing starting movements, wherein the eyelet 9 at the free end of the line 6 is hooked onto a belt holder 19.

An especially good training effect is obtained because, in addition to developing the forces which accelerate his running movements, the sprinter 18 must also overcome a restraining force, produced essentially by the friction element 10. The extent of the restraining force can be preselected by the use of the screw element 13, which adjusts the tension of the helical spring 13.

In the exemplary embodiment shown here, the length of the line 6 is calculated for a sprinting distance of up to 25 m, wherein an additional extendable length of line is taken into account to allow for the braking of the running movement after this sprinting distance has been exceeded. The device can be prevented from being overloaded by designing the eyelet 9 so that it automatically separates from the belt holder 19 when the line 6 has been completely unwound from the pulley 5.

The pulley 5 could be provided at 20 with a spiral-shaped return spring (not shown), which has the function of automatically rewinding the strand which has been pulled out of the housing of the holder 1 after the screw element 13 has been used to release the pressure acting on the line 6. The line 6 could, instead, be wound up by hand by the use of a gripping piece 21, which projects from the housing of the holder 1 and which could, if desired, be designed to fold down out of the way.

In the following, parts which are the same or which serve the same function are designated by the same reference numbers as in the preceding exemplary embodiment, wherein the letter "a" or "b" is appended to the reference number in question.

Figure 4:
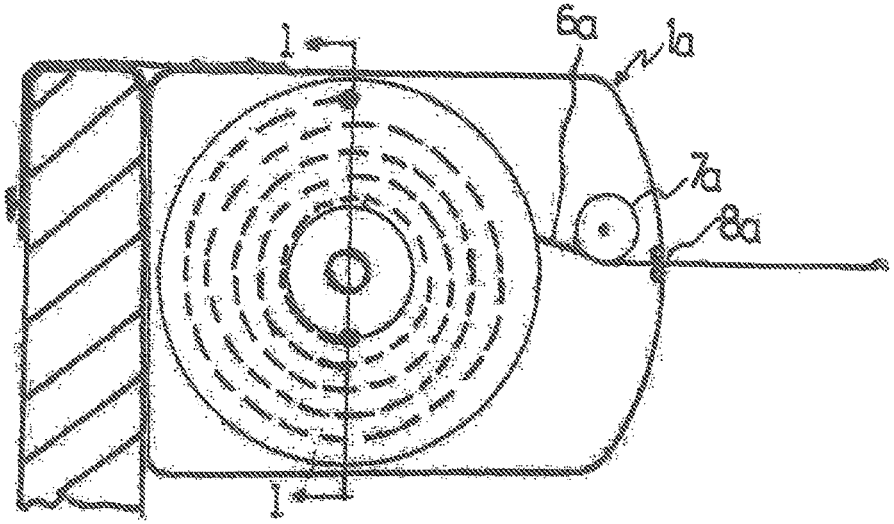
FIG. 4 shows a holder of another device described in the parent application.
Figure 5:
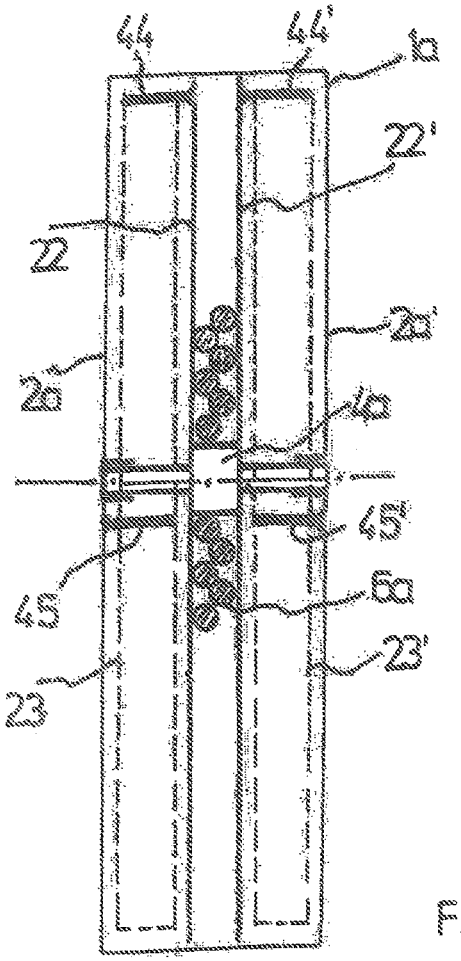
FIG. 5 shows a cross-section of the holder along line I-I of FIG. 4.

In the case of the exemplary embodiment shown in FIGS. 4 and 5, the same or similar-acting parts are designated by the same reference numbers as in the preceding exemplary embodiment, wherein the letter "a" is appended to the reference number in question. b1

A pulley 4*a* supported between the side walls 2*a*, 2*a*' of the housing 1 comprises end plates 22 and 22', the diameters of which are several times larger than the diameter of the pulley. A rope-like line 6*a* wound up on the pulley 4*a* is held laterally between the end plates 22 and 22'. On each side of the pulley 6*a*, a spiral spring 23, 23' is arranged. The outer ends of the springs 23, 23' are connected to the end plates 22, 23° by bolts 44, 44'. At the inner ends, the spiral springs 23, 23' are fixed to the housing 1a by bolts 45, 45'.

In the exemplary embodiment shown in FIGS. 4 and 5, the spiral springs serve not only to pull the line 6*a* back into the housing la but also to generate the desired restraining force while the line is being pulled out. In contrast to the preceding exemplary embodiment, this restraining force is also being applied when the runner who is pulling the line 6*a* out is standing still or is moving backwards. This makes it possible to achieve additional training effects.

Figure 6:
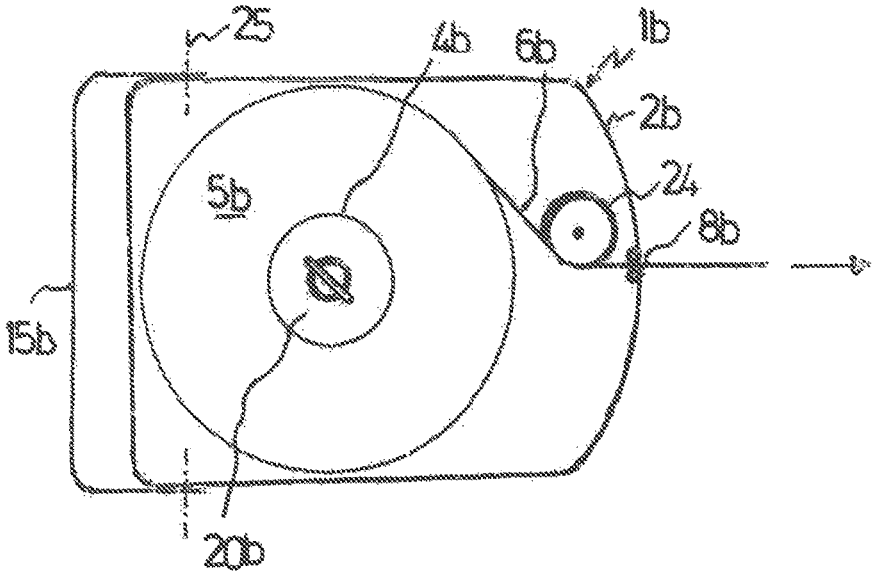
FIG. 6 shows a holder according to an exemplary embodiment of the invention.
Figure 7:
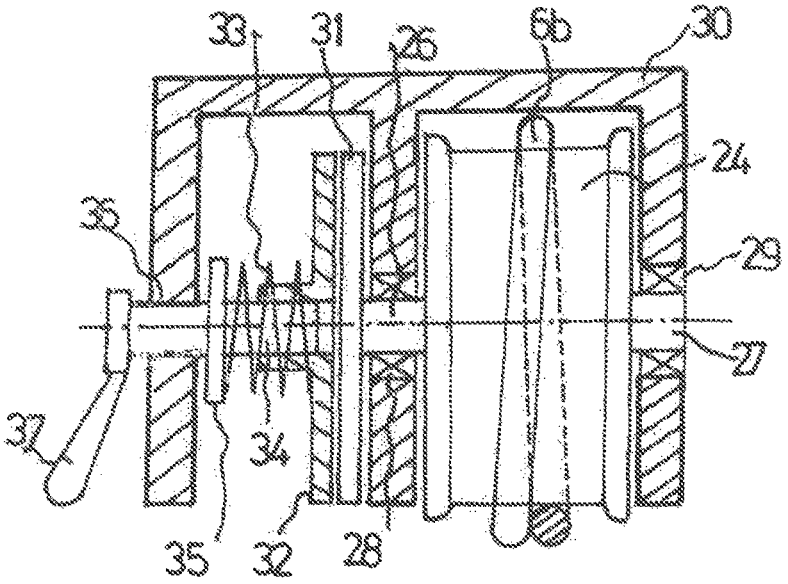
FIG. 7 shows a detail diagram of a pulley used in the holder of FIG. 6.

An exemplary embodiment of a restraining device shown in FIGS. 6 and 7 comprises not only a supply pulley 4*b* to hold a wound-up line 5*b* but also an additional pulley 24. A cord-like line 6*b* wound up on the pulley 4*b* is wrapped once around the pulley 24 before it leaves the housing 2*b* holding the pulleys 4*b* and 24 through an opening 8*b* and thus reaches the outside.

A U-shaped anchoring element 15*b* is hinged at both ends to the housing 2*b* and can pivot around a rotational axis 25 extending between the two ends of the U.

FIG. 7 shows the pulley 24 and its support in detail. Stub axles 26 and 27 projecting axially from the pulley 24 are free to rotate in bearings 28 and 29, which are mounted in a holding frame 30. The stub axles 26, 27 and the pulley 24 are connected in such a way that no rotation is possible in one direction. In the opposite rotational direction, a freewheel (not shown) is formed between the stub axles and the pulley.

The stub axle 26 is connected nonrotatably to a first brake disk 31, coaxial to the pulley 24, against which a second brake disk 32, also coaxial to the pulley 24, can be pressed in the axial direction by a helical spring 33. The second brake disk 32 is supported nonrotatably but with freedom to shift in the axial direction on an axle pin 34. One end of the helical spring 33 rests against a collar 35 on the axle pin 34, whereas the other end rests against the second brake disk 32. By means the screw thread at 36, the axle pin 34 can be rotated to adjust its axial position in the holding frame 30. A crank 37 is used to rotate the axle pin 34.

When the line 6*b* is pulled out of the housing 2*b* of the holder 1b, the pulley 24 is turned by the line 6*b*, which is wrapped around it. The braking device formed by the brake disks 31, 32 inhibits this rotation and produces a restraining force acting in the direction opposite the pull-out direction. The strength of this restraining force can be adjusted by using the crank 37 to turn the axle pin 34, which has the effect of changing the pretension of the helical spring 33 resting between the collar 35 and the second brake disk 32.

When there is no longer any pulling force being exerted on the line 6*b*, a spiral spring (not shown) mounted in the supply pulley 4*b* at 20*b* automatically pulls the line 6*b* back into the housing and winds it up on the pulley 4*b*. The opposing force produced by the spiral spring as the line is being pulled out is small in comparison to the restraining force produced by the braking device.

Figure 8:
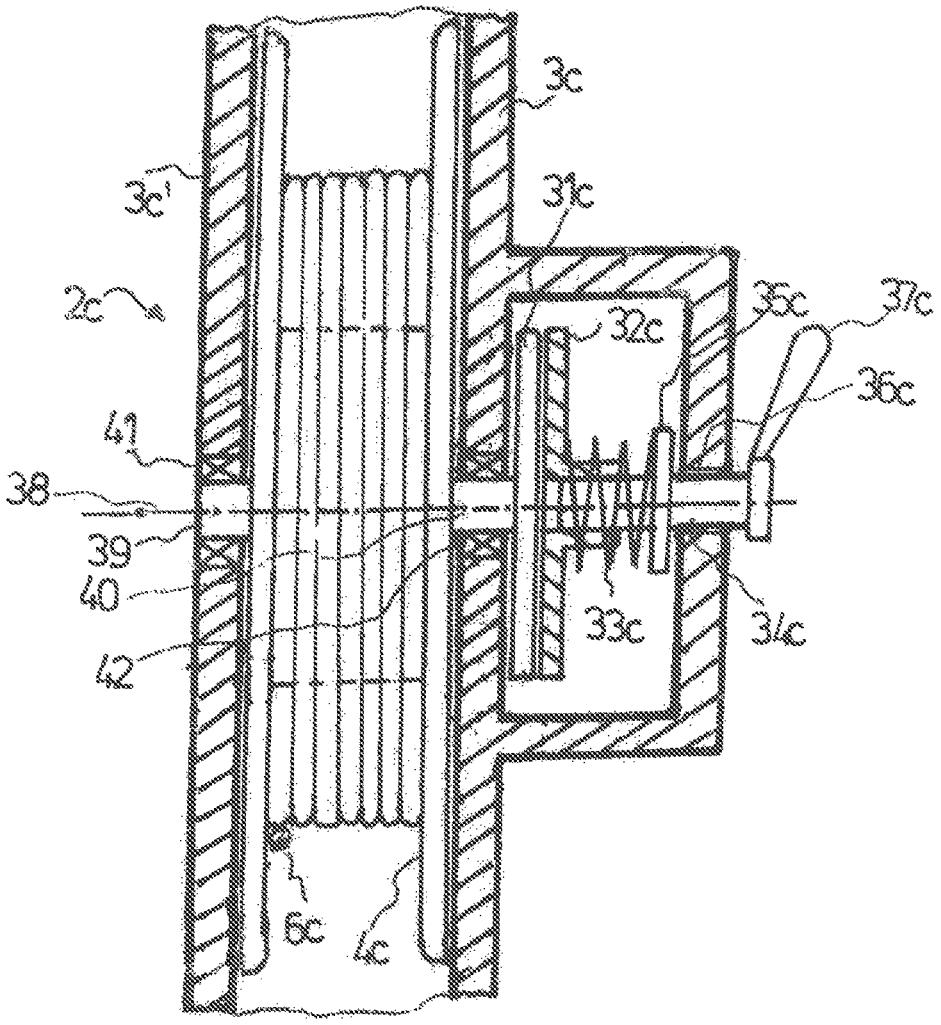
FIG. 8 shows a partial diagram of a holder according to another exemplary embodiment of the invention.

A restraining device partially shown in FIG. 8 comprises a flat housing 2*c* with side walls 3*c* and 3*c*'. Between the side walls 3*c*, 3*c*' there is a pulley 4*c*, which can rotate around an axis 38 when the rope line 6*c* is being unwound or rewound.

Stub axles 39, 40 projecting from the pulley 4*c* engage in bearings 41, 42 in the side walls 3*c*, 3*c*'. The stub axle 42 is nonrotatably connected to a brake disk 31*c* coaxial to the pulley 4*c*. A second brake disk 32*c* coaxial to the brake disk 31*c* can be pressed against the former brake disk 31*c* by a helical spring 33*c* and is supported nonrotatably but with freedom to shift in the axial direction on an axle pin 34*c*. One end of the helical spring 33*c* rests against a collar 35*c* on the axle pin 34*c*, whereas the other end rests against the brake disk 32*c*.

By way of a screw thread 36*c* in the holding frame 30*c*, the axle pin 34*c* can be turned to adjust its axial position, wherein a crank 37*c* is used to turn the axle pin.

The braking force acting between the brake disks can be suitably adjusted by turning the crank 37, which thus adjusts the force required to unwind the line 6*c* from the pulley 4*c*
.

The invention claimed is:

1. A training device for sprinters, comprising: a permanently anchored or anchorable holder; a line, which is connectable to a user, pullable out from the holder against a restraining force over a sprinting distance traveled by the user; a supply pulley from which a length of the line corresponding to the sprinting distance is unwound; and devices for producing the restraining force by sliding friction, wherein the devices for producing the restraining force by sliding friction include the supply pulley, which rotates when the line is pulled from the supply pulley, and a braking device that inhibits rotation of the supply pulley, wherein the braking device has two brake disks coaxial with and axially spaced from the supply pulley, a second of the brake disks being axially pressable together with a first of the brake disks to inhibit rotation of the supply pulley, wherein the supply pulley has two stub axles that rotatably rest within bearings mounted at opposing side walls of a housing that surrounds the supply pulley, wherein first brake disk is nearer to the supply pulley than the second of the brake disks and is rotated together with the supply pulley by a respective one of the stub axles.

2. The training device according to claim 1, wherein the line can be unwound from the supply pulley under rotation of the supply pulley against a restoring torque.

3. The training device according to claim 2, further comprising a spring arranged to provide the restoring torque.

4. The training device according to claim 1, wherein the supply pulley is free to rotate, uninhibited by the braking device, in a rotational direction opposite a pulling-out direction.

5. The training device according to claim 1, wherein the second brake disk is actable upon in a direction of a rotational axis of the pulley by an adjustable braking force.

6. The training device according to claim 5, including a spring of adjustable pretension that exerts the braking force on the second brake disk.

7. The training device according to claim 1, wherein the holder is transportable and comprises devices for anchoring on different supports.

8. The training device according to claim 1, wherein a U-shaped anchoring element has ends connected to the holder so that the holder is designed as a device for anchoring on different supports.

9. The training device according to claim 8, wherein the U-shaped anchoring element is hinged to the holder so as to be rotatable around a rotational axis extending between the ends of the U-shaped anchoring element.

10. The training device according to claim 1, wherein the line is a rope.

* * * * *